United States Patent [19]

Misevich et al.

[11] Patent Number: 4,557,059

[45] Date of Patent: Dec. 10, 1985

[54] ATHLETIC RUNNING SHOE

[75] Inventors: Kenneth W. Misevich, Fairfield, Conn.; John L. A. Wilson, Brookline, Mass.

[73] Assignee: Colgate-Palmolive Company, New York, N.Y.

[21] Appl. No.: 465,023

[22] Filed: Feb. 8, 1983

[51] Int. Cl.[4] ..... A43B 5/00; A43B 13/04; A43B 13/12

[52] U.S. Cl. ..... 36/32 R; 36/129; 36/114; 36/25 R; D2/320

[58] Field of Search ..... 36/25 R, 32 R, 59 C, 36/127, 129, 114, 103, 30 R; D2/309, 320

[56] References Cited

U.S. PATENT DOCUMENTS

| | | | |
|---|---|---|---|
| 4,149,324 | 4/1979 | Lesser et al. | 36/127 |
| 4,161,829 | 7/1979 | Wayser | 36/127 |
| 4,399,621 | 8/1983 | Dassler | 36/32 R |
| 4,449,306 | 5/1984 | Cavanagh | 36/30 R |

FOREIGN PATENT DOCUMENTS

| | | | |
|---|---|---|---|
| 2037569 | 7/1980 | United Kingdom | 36/103 |

*Primary Examiner*—Werner H. Schroeder
*Assistant Examiner*—Steven N. Meyers
*Attorney, Agent, or Firm*—LeBlanc, Nolan, Shur & Nies

[57] ABSTRACT

An athletic shoe having a sole bottom which is contoured in the region of first foot strike along the lateral border to provide an arcuate landing surface which curves upwardly toward the lateral side edge of the sole and away from the ground surface and which is radiused about an axis coinciding with an effective, average subtalar axis. The sole may additionally be contoured along the rear heel portion in the region of first foot strike for straight heel strikers to provide another arcuate landing surface which curves upwardly toward the rear edge of the sole and which is radiused about a transverse axis coinciding with an average ankle axis. The sole bottom is formed with separate sets of gripping ribs which are oriented in such a manner that traction is enhanced for a range of toe out angles in the toe off range, is maximized for an average toe out angle along the lateral border and is maximized for a zero toe out angle in the rear heel region.

13 Claims, 16 Drawing Figures

ATHLETIC RUNNING SHOE

FIELD OF INVENTION

This invention relates to athletic running shoes and particularly to athletic shoes which are designed for high speed running. Running shoes of this type customarily have a foamed midsole overlying and attached to an outsole. Some shoes of this type have gripping formations on the outsole to enhance traction. The present invention is directed to improvements in the contour of the sole structure and also to improvements in the outsole tread pattern.

DEFINITIONS

In this specification, the term "rearfoot" is used to identify the heel portion of the foot containing the heel bone (the calcaneus) and the talus, the term "midfoot" is used to identify the intermediate portion of the foot lying between the rearfoot and forefoot and containing the cuboid, the navicular and the cuneiforms, and the term "forefoot" is used to identify the foot portions lying forwardly of the midfoot and containing the metatarsals and the toes.

BACKGROUND

When running, the initial landing position of the foot (or initial contact foot strike as it is called) varies for different running styles. For example, a classical rearfoot striker lands on the rear outside or lateral border of the foot. Other runners (referred to as midfoot strikers) make initial ground contact closer to the midpart of the foot, and a few runners (referred to as straight heel strikers) land on the back of the heel rather than the lateral border.

Straight heel strikers, sometimes described as straight toe "Indian runners", typically have a 0° toe out. Runners who make initial foot strike along the outsole's lateral border, however, typically toe out by a specific angle. Depending on the runner's particular running style, the toe out ranges from something slightly more than 0° to about 30°. The average toe out for runners who land on the outsole's lateral border is about 16°.

Furthermore, a runner, such as a rearfoot striker, who makes initial contact foot strike along the outsole's lateral border pronates about his subtalar axis after landing to plant his foot in a flat or pronated position on his forefoot. From the position on the forefoot, the runner rises up on his toes to propel himself forwardly.

Known outsole rib designs or patterns, which are used for traction, do not account for variations of toe out. Furthermore, known outsole rib patterns are not arranged to optimize traction and to reduce wear for an average toe out of about 16°, especially for initial foot strike at the lateral border of the sole.

Another significant problem with known conventional running shoes is that the bottom of the sole is typically flat or essentially flat and terminates in a relatively sharp, ground level edge along the lateral or outside border of the shoe in the region of initial foot strike. Rearfoot strikers therefore land on this edge before pronating to a flat forefoot position. Although this edge deforms to some extent under the runner's load, it nevertheless creates an artificial fulcrum which promotes an unstable landing as well as causing the foot to pronate abruptly into a flat position with a significant impact.

SUMMARY AND OBJECTS OF INVENTION

With the foregoing in mind, the general aim and purpose of this invention is to provide a novel athletic running shoe which solves the artificial fulcrum problem mentioned above and which improves traction, as well as reducing wear, for different types of foot strikers and a wide range of various toe out angles.

In carrying out this invention, the bottom of the sole, rather than being flat, is contoured in the region of first foot strike along the lateral border. The contoured landing surface curves upwardly toward the lateral or outside edge of the shoe and is radiused about a preset axis corresponding to an average subtalar axis (i.e., a subtalar axis having an average inclination of about 42° in the vertical or sagittal plane and an average deviation of about 20° from the midline or centerline of the foot in a horizontal plane). This contoured configuration eliminates the artificial fulcrum which is created by the edge of the sole in conventional athletic running shoes. In doing so, it provides a stable landing surface and also enables the runner to pronate smoothly and freely in making the transition from initial foot contact along the lateral border to a flat or midsupport position. As a result, the contoured sole of this invention improves the dynamic stability of the shoe (i.e., while running) and reduces the peak impact force, especially during the initial foot strike phase.

In addition to the contoured lateral border, the rear heel portion of the sole curves upwardly toward the back of the heel and is advantageously radiused about an average ankle axis. This contoured heel surface therefore enables the runner to smoothly and freely rotate his foot about his ankle axis and is especially useful for heel strikers who make the initial landing at or near the rear portion of the heel.

With regard to the outsole tread design of this invention, it has been observed that rib formations afford maximum traction and have least wear when they are oriented to extend normal to the direction of motion. The optimum orientation of rib formations therefore depends on the runner's toe out angle, which varies for different runners. The present invention has three sets of outsole gripping ribs which are based upon this principle. These sets of ribs are located at different regions of the outsole (namely, the lateral border, the rear heel region and the toe-off region) and are independently oriented in such a manner that traction is improved for a wide range of toe out angles in the outsole's toe-off region, is maximized for an average toe out angle of about 16° along the outsole's lateral border, and is maximized for a 0° toe out angle in the outsole's rear heel region at the back edge of the heel.

In addition to enhancing traction, the orientation of the gripping ribs has the effect of reducing wear, thereby enabling the outsole thickness to be reduced to reduce the weight of the shoe and also to enhance the flexibility of the shoe.

A fourth set of ribs is advantageously located along the medial border under the runner's medial or inside arch. Being in an area of negligible wear, the fourth set of ribs is oriented to improve support for excessive pronaters rather than improving traction or reducing wear.

In the outsole tread design of this invention, the rib formations do not occupy the entire sole, but instead lie just in the forward toe portion, the rear heel portion, the lateral border, part of the medial border and the medial arch area. The portion of the sole left unoccupied by rib formations contains an array of small, circularly cross-sectioned gripping cleats or nubs, as they are called. The nubs extend along the central forefoot region behind the toe region, the central midfoot region and the central heel region under the calcaneus. These nubs are configured to provide omnidirectional traction and additional cushioning for the foot. Being omnidirectional, the nubs in the forefoot region enhance traction for turning and twisting movements about the ball of the foot.

The contoured sole configuration referred to above may be used with or without the foregoing outsole tread design. However, sole-to-ground contact is enhanced by providing the foregoing rib formations along the contoured regions of the sole.

With the foregoing summary in mind, a further object of this invention is to provide a novel athletic running shoe having a contoured sole for improving the dynamic stability of the shoe (i.e., while running) and enabling the runner to pronate smoothly and freely about his subtalar axis.

Yet another object of this invention is to provide a novel athletic running shoe in which the rear heel portion of the sole curves upwardly towards the back of the heel and is radiused about an average ankle axis.

A further object of this invention is to provide a novel outsole tread pattern having separate sets of ribs each oriented independently of the other in such a manner that traction is enhanced over a relatively wide range of toe out angles in the outsole's toe or toe-off region, is maximized for an average toe out angle of about 16° along the outsole's lateral border and is maximized for a 0° toe out angle in the outsole's rear heel region at the back edge of the heel.

Yet another object of this invention is to provide a novel outsole tread pattern in which ribs occupying the outsole's medial border lie at least approximately parallel to the direction of travel for a relatively large toe out angle greatly exceeding the average toe out angle to provide additional support for excessive pronaters.

Further objects of this invention will appear as the description proceeds in connection with the below-described drawings and appended claims.

DETAILED DESCRIPTION

Figure 1:
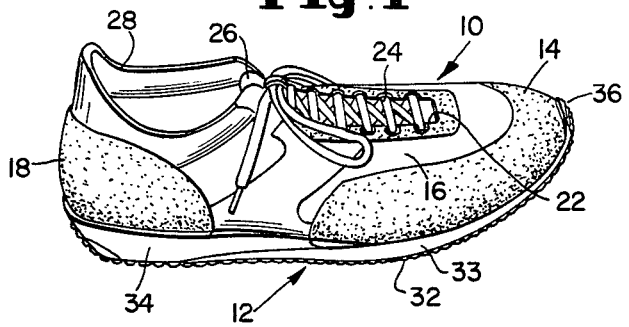
FIG. 1 is a perspective view of a right foot athletic running shoe incorporating the principles of this invention as viewed from the shoe's lateral border.
Figure 2:
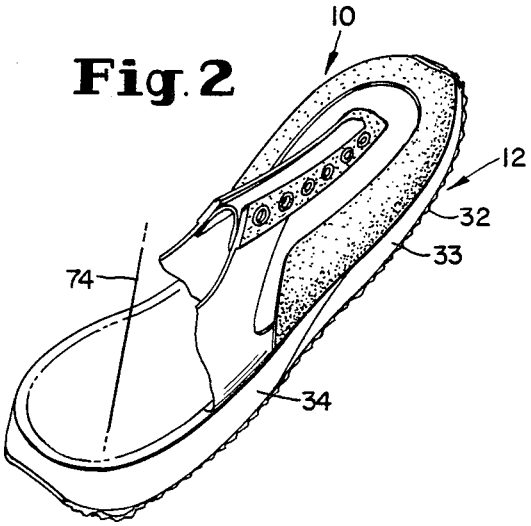
FIG. 2 is another perspective view of the shoe with the upper broken away to show the location of the average subtalar axis.
Figure 3:
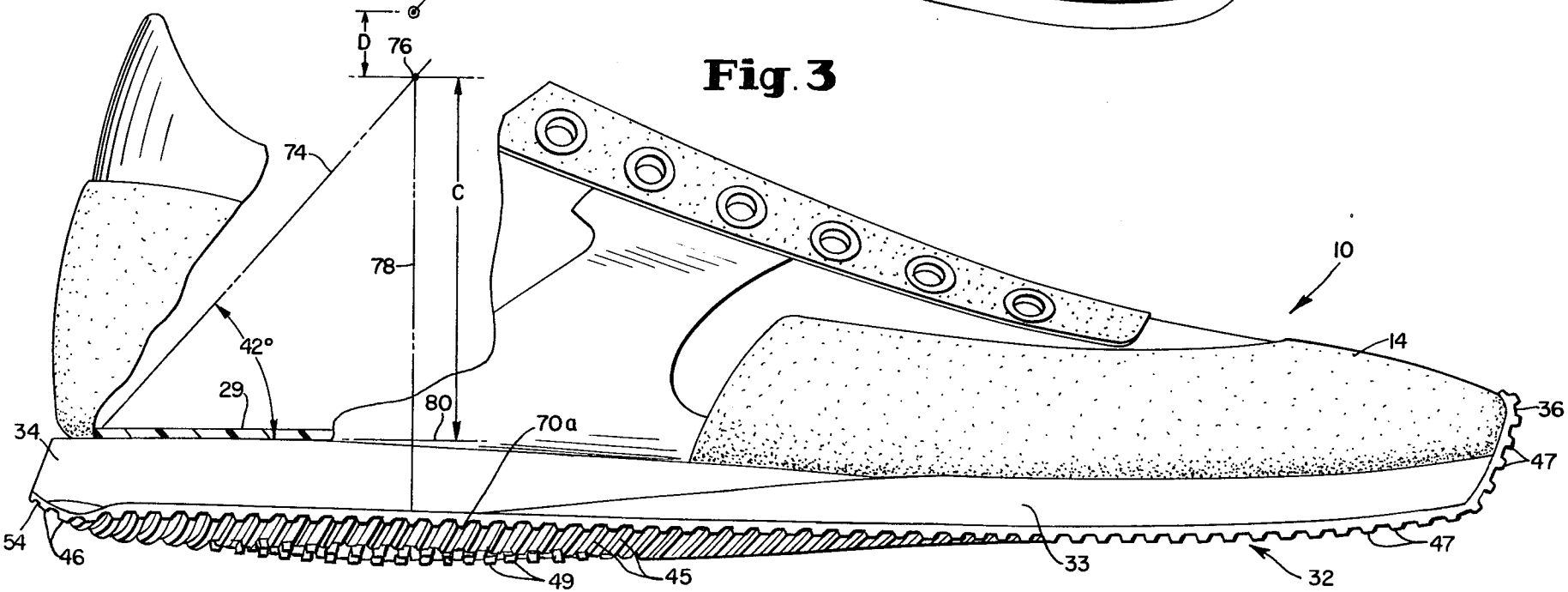
FIG. 3 is a side elevation as viewed from the shoe's lateral border and having portions partially broken away to illustrate more clearly the vertical projection of the subtalar axis and other details of the shoe.

Referring to FIGS. 1–3, the athletic running shoe of this invention comprises a flexible upper 10 and a laminate bottom or sole unit 12 underlying the upper 10.

Upper 10 may be of any suitable, conventional construction and is shown to comprise a toe portion or toe box 14, a vamp portion 16, a heel portion 18, a throat 22 extending along vamp portion 16 for the lacing which is indicated at 24, a tongue 26 extending along throat 22 and a collar 28 extending around the shoe's foot-receiving opening.

In the illustrated embodiment, upper 10 is of the board-lasted type having an open bottom which is closed by an insole board 29 (see FIG. 3). Alternatively, upper 10 may be of the sliplasted type (not shown) having closed fabric bottom so that the upper extends completely around the foot like a slipper.

Sole unit 12 comprises a flexible, elastically deformable, ground-engaging, one-piece outsole 32, a flexible, foamed, shock-absorbing midsole layer 33 overlying and bonded to outsole 32, and a foamed, heel lift or heel wedge 34 overlying and bonded to midsole layer 33 under the wearer's rearfoot and midfoot regions. Heel wedge 34 is tapered to have a maximum thickness under the heel for raising the wearer's heel in the customary manner.

In the illustrated embodiment, heel wedge 34 is formed separately of midsole layer 33. Alternatively, heel wedge 34 may be formed as an integral part of midsole layer 33. In either case, heel wedge 34 is considered to be part of the foamed midsole structure. Upper 10 and insole 29 are bonded to or otherwise suitably fixed to midsole layer 33 and heel wedge 34.

Outsole 32 may be molded from any suitable resilient, tough synthetic or natural rubber material which is preferably highly resistant to wear such as the Indy 500 compound which is marketed by Goodyear Rubber. Midsole layer 33 and heel lift 34 are formed from any suitable, lightweight, closed cell polymeric foam, shock-absorbing material. For example, midsole layer 33 and heel lift 34 may be formed from a blend of ethylene vinyl acetate and polyethylene and then cross-linked with a peroxide during molding.

As shown in FIGS. 1 and 3, outsole 32 and midsole 33 extend the full length of the shoe from the heel end to the toe end. The forward end portion of outsole 32, which extends beyond midsole layer 33, is curved upwardly and is adhered to the front edges of midsole layer 33 and the upper's toe portion 14 to form a toe wrap 36.

The illustrated running shoe is of the curved last type having a rearquarter centerline 42 (see FIG. 4) which bisects the rearfoot portion of outsole 32 and which extends parallel or approximately parallel to the lateral side edge of sole unit 12. Because of the confinement of the back half of the foot in the shoe, the centerline of at least the back half of the wearer's foot (which extends centrally through the wearer's calcaneus) approaches coincidence with centerline 42. Line 42 is therefore considered to be both the centerline of the foot and centerline of the rear-quarter of the shoe, although it will be appreciated that the true centerline of the wearer's foot intersects the rearquarter centerline at a small acute angle and extends between the second and third metatarsal.

Figure 6:
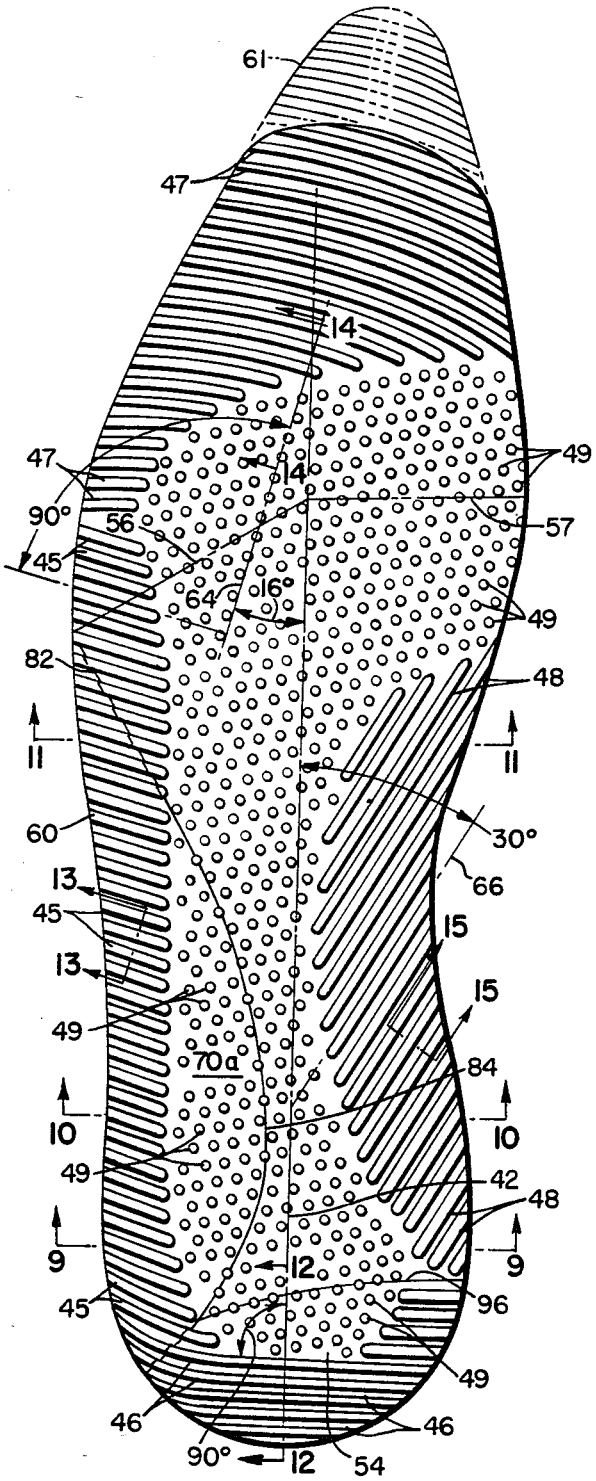
FIG. 6 is a bottom plan view of the running shoe and illustrating the novel outsole tread design of this invention.
Figure 14:
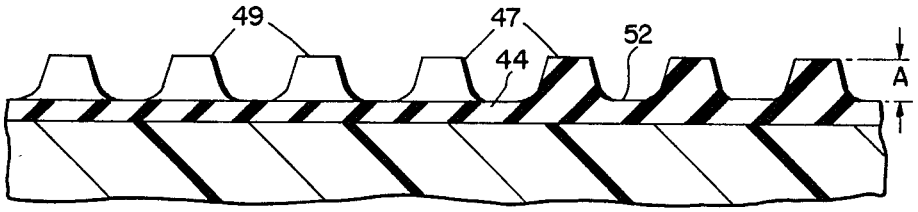
FIG. 14 is an enlarged fragmentary section taken substantially along lines 14—14 of FIG. 6.

Referring to FIGS. 6 and 14, outsole 32 is formed with a base portion 44 and a novel tread pattern having four separate sets of ground-engaging gripping ribs or ridges 45, 46, 47 and 48 and an array or cluster of small, ground-engaging, circularly cross-sectioned, gripping cleats or nubs 49. Ribs 45–48 and nubs 49 are integral with and extend from base portion 44. Outsole 32 is bonded to the underside of midsole 33 along the smooth upper face of base portion 44. Base portion 44 has a major exterior surface 52 (see FIG. 14) from which the ribs 45–48 and nubs 49 perpendicularly extend.

Base portion 44 is formed with a uniform thickness and is relatively thin to enhance the flexibility of the shoe. The thickness of base portion 44 is about 1/32 inches.

Figure 13:
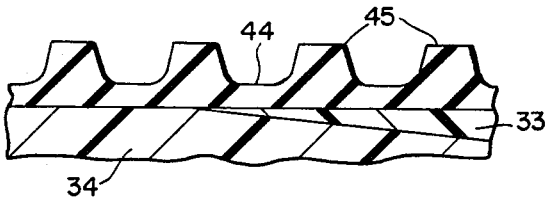
FIG. 13 is an enlarged fragmentary section taken substantially along lines 13—13 of FIG. 6.
Figure 15:
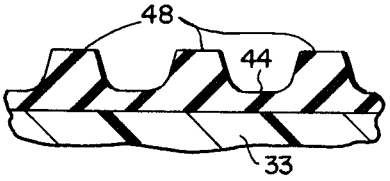
FIG. 15 is an enlarge fragmentary section taken substantially along lines 15—15 of FIG. 6.

In the illustrated embodiment, each of the ribs 45–48 is generally rectangular in cross-section (see FIGS. 13–15). The vertical lengths of ribs 45–48 and nubs 49 are the same so that they all extend by the same vertical distance (see dimension A in FIGS. 13–15) from the base portion's major exterior surface 52 to terminate in ground-engaging ends which all lie at a common level. Dimension A is preferably about 1/16 inches.

In addition to having a common height, the widths of ribs 45–48 are also uniform. Accordingly, ribs 45–48 have a uniform aspect ratio (i.e., the ratio of rib width to rib height), which is preferably about 1:1. The width of each rib is about 1% of the total length of the shoe and is about 1/16 inches for a men's size 9E.

Nubs 49 (see FIGS. 6 and 14) are uniformly dimensioned and are of like truncated frustoconical configuration. Nubs 49 are also considered to have an aspect ratio of about 1:1 in that the length or vertical dimension A of each nub is about equal to its diameter at its flat ground-engaging end face. The 1:1 aspect ratio for ribs 45–47 and nubs 49 insures gripping traction without any significant sliding or wearing.

As described in detail below, the three sets of ribs 45, 46 and 48 lie at different angles relative to centerline 42. The preferred angles are indicated in FIG. 6. It will be appreciated, however, that desired results are satisfactorily achieved with angulations that are only approximately equal to the preferred angles, but nonetheless differ slightly from the preferred angles. Preferably, the angulations of ribs 45, 46 and 48 lie within $\pm 3°$ of the preferred angles. Angulations of the ribs lying within this range are considered to be approximately equal to the illustrated, preferred angles.

As shown in FIG. 6, ribs 45 extend just along the lateral border of outsole 32 throughout the entire region extending from a rear heel portion or border region 54 to a point lying forwardly of the oblique metatarsal axis. The oblique metatarsal axis is depicted by a line 56 in FIG. 6. It extends at least approximately through the metatarsal joints at the metatarsal heads of the third, fourth and fifth metatarsals and intersects the transverse metatarsal axis (indicated at 57 in FIG. 6) at an oblique angle in the region of the joint at the metatarsal head of the second metatarsal. The transverse metatarsal axis passes at least approximately through the joints at the metatarsal heads of the first and second metatarsals.

The foremost one of ribs 45 lies between the tip of the wearer's small toe and the joint connecting the small toe to the fifth metatarsal. The rearmost one of ribs 45 lies immediately adjacent to the rear heel region 54 which is smoothly curved along a uniform radius of curvature as will be described in greater detail later on. Ribs 45 are straight, parallel and uniformly spaced apart. The spacing between ribs 45 is at least as great as and preferably somewhat greater than the rib width.

Still referring to FIG. 6, ribs 45 extend inwardly toward centerline 42 from the outsole's lateral or outside edge 60. Ribs 45 lie to one side of and are spaced by a substantial distance from centerline 42. Along the outsole's rearfoot region, ribs 45 occupy only about 20 percent of the width of the outsole. Ribs 45 occupy the entire region of initial contact foot strike along the lateral border.

As shown in FIG. 6, ribs 45 are slanted relative to centerline 42 so that they extend at right angles to a line 64 which intersects centerline 42 at an acute angle of at least approximately 16°. Line 64 depicts the line or direction of travel of a runner who toes out by an angle of 16°, which is the average toe out as previously mentioned. Ribs 45 therefore will lie perpendicular to the direction of travel of a runner who toes out by the average angle of 16°.

As previously explained, maximum traction is achieved with least wear for rib formations, such as ribs 45, when the ribs are oriented to extend perpendicular to the line or direction of travel, because the ribs will dig into the ground and roll back. Conversely, ribs extending parallel to the direction of travel will roll over least, thus providing the least traction. Because of their orientation and location, ribs 45 therefore provide maximum traction with least wear for runners having an average toe out of 16°.

As shown in FIG. 6, ribs 46 lie in the region of first foot strike for straight heel strikers and occupy just the rear heel border region 54 which partially encircles the central portion of the wearer's calcaneus. Like ribs 45, ribs 46 are straight, parallel, and uniformly spaced apart. Additionally, the spacing between ribs 46 is the same as the spacing between ribs 45.

Ribs 46 lie normal or at least approximately normal to centerline 42. This angular orientation of ribs 46 therefore provides maximum traction with least wear for 0° toe out heel strikers who make initial foot contact at the rear heel border region 54.

As shown in FIG. 6, ribs 47 are smoothly curved, occupy the outsole's entire toe-off region under the wearer's toes and extend from the tip of toe wrap 36 back to a region lying forwardly of and spaced from the metatarsal axes 56 and 57. Ribs 47 extend across the full width of outsole 32 in the toe-off region under the wearer's toes. The spacing between ribs 47 is uniform and preferably equal to the spacing between ribs 45. In FIG. 6, line 61 depicts toe wrap 36 when it is straightened to lie flat with the remainder of outsole 32.

The curvature of each of the ribs 47 coincides approximately with a parabola and is established by at least two and preferably three conditions or points: first, a line extending tangentially of a selected rib at or near the medial edge of the sole normally intersects a line parallel to line 66; second, a line extending tangentially of the selected rib at or near the lateral edge of the sole normally intersects centerline 42; and third, a line extending tangentially of the selected rib roughly midway between its medial and lateral ends normally intersects a line parallel to line 64. The remaining ribs 47 are set parallel to the selected rib mentioned above.

Because of their curvature, ribs 47 have segments which lie closely perpendicular to the direction of travel for a range of toe out angles extending from about 0° to about 30°. The curvature of ribs 47 therefore enhances traction and reduces rib wear for a range of toe out angles, rather than a single toe out angle. It will be noted that the shorter rearmost ribs 47 at the lateral side edge are closely perpendicular to centerline 42.

From the description thus far, it will be appreciated that ribs 45–47 are oriented in such a manner that traction is improved for a wide range of toe out angles in the outsole's toe-off region, is maximized for an average toe out angle of about 16° along the outsole's lateral border, and is maximized for a 0° toe out angle in the outsole's rear heel region at the back edge of the heel.

Like ribs 45, ribs 48 are straight, parallel and uniformly spaced apart. The spacing between ribs 48 is the same as the spacing between ribs 45. Ribs 48 extend along the outsole's medial border from the rearward edge of the medial border adjacent to ribs 46 to a region lying just forwardly of the midfoot region and spaced rearwardly from the transverse metatarsal axis 57. In the midfoot region, ribs 48 extend inwardly to centerline 42 to underlie the wearer's medial arch. As shown, ribs 48 are spaced laterally from ribs 45.

The outsole region occupied by ribs 48 will be subject to negligible wear. Rather than being oriented to reduce wear and improve traction, ribs 48 are therefore oriented to lie parallel to a direction of travel for a preselected toe out angle to provide extra support for the foot. In the illustrated embodiment, ribs 48 lie parallel to line 66 and therefore align with the direction of travel for an extreme toe out angle of about 30°. Ribs 48 will therefore be loaded parallel to the direction of motion for a toe out angle of about 30° and are therefore much less susceptible to rolling over as compared with ribs 45–47. Accordingly, ribs 48 enhance the support for runners who toe out excessively and who, statistically, are the greatest pronaters.

From the foregoing description it will be appreciated that a toe out runner will make initial foot contact on ribs 45 at the outsole's lateral border with near maximum traction, then receives medial support from ribs 48 upon pronating, and finally toes off on ribs 47 with near maximum traction.

As shown in FIG. 6, ribs 45 occupy the entire lateral border lying between ribs 46 and 47, and ribs 48 extend to the back edge of the medial border adjacent to ribs 46 so that apart from the normal spacing of ribs, the only gap between the four sets of ribs lies between ribs 48 and ribs 47 in the region underlying the wearer's first metatarsal head and extending forwardly and rearwardly of the transverse metatarsal axis 57. Nubs 49 occupy this gap as well as the remaining region left unoccupied by ribs 45–48.

From the foregoing description it will be appreciated that nubs 49 are peripherally surrounded by ribs 45–58 except at the gap between ribs 47 and 48 where the nubs extend to the medial side edge of the sole. Nubs 49 thus lie in the region of the metatarsal heads forwardly and rearwardly of the metatarsal axes 56 and 57, extend along the central midfoot region of the sole and occupy the central heel region centrally under the wearer's calcaneus. The forwardmost row of nubs 49 lie under the rearward portion of the wearer's phalanges adjacent to the metatarsal heads at a location spaced forwardly from the back end of the shoe by about 70 percent of the shoe length. Nubs 49 therefore underlie the ball of the foot (i.e., the forefoot region lying below the metatarsal heads) as well as the other regions mentioned above.

The diameter of the ground-engaging flat end face of each nub is preferably equal to the width of ribs 45. The spacing of nubs 49 is uniform and preferably equal to or at least approximately equal to the spacing between ribs 45. Because of the large number of nubs 49 the outsole is provided with what may be considered as a fine cone tread in the region left unoccupied by ribs 45–48.

Because of their configuration, nubs 49 provide omnidirectional traction in the sense that they can flex in any direction. Nubs 49 therefore provide significant traction for twisting and turning as well as running along a straight line of travel. Furthermore, the close grouping and the multiplicity of nubs 49 provide additional cushioning for the foot. In addition, the close grouping and uniform spacing of nubs 49 load midsole 33 more uniformly to reduce midsole degradation.

The spacing between each set of ribs 45–48 and between nubs 49 maintains a high degree of flexibility of the shoe and also affords a self-cleaning action so that pebbles and other small particles do not lodge or stick between the rib and nub formations.

According to another aspect of this invention, the bottom of midsole 33 is contoured along the lateral border to provide an arcuate surface 70 as shown in FIGS. 7–11. Surface 70 curves radially upwardly toward the lateral or outside side edge of the sole and lies in a conical envelope 72 having an axis of symmetry 74 (see FIGS. 2–4) coincident with an effective subtalar axis which statistically represents an average subtalar axis for different individuals. An individual's effective subtalar axis is an oblique axis about which foot portion below the talus rotates. When pronating (or conversely supinating), a runner's foot articulates about his effective subtalar axis.

Figure 4:
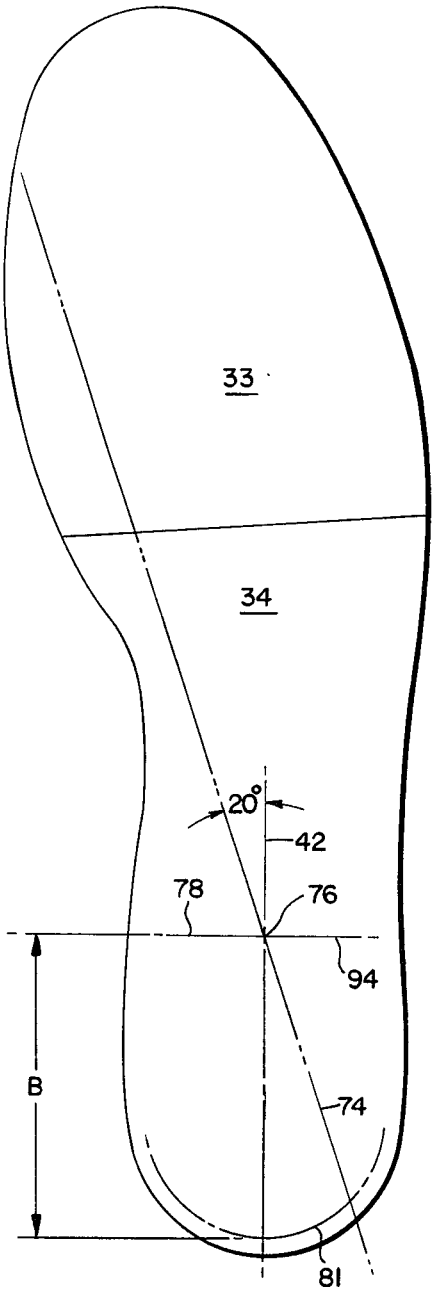
FIG. 4 is a plan view of the athletic shoe with the upper and insole removed to show the subtalar axis projected into a horizontal plane on the top surface of the midsole structure.

As shown in FIGS. 3 and 4, the average subtalar axis (i.e., axis 74) is statistically determined to have an average inclination of about 42° relative to a horizontal line in the vertical or sagittal plane containing centerline 42 and an average inward angular deviation of about 20° from the midline of the foot and hence from centerline 42 in a horizontal plane which is depicted by a line 80 in FIG. 4.

Figure 9:
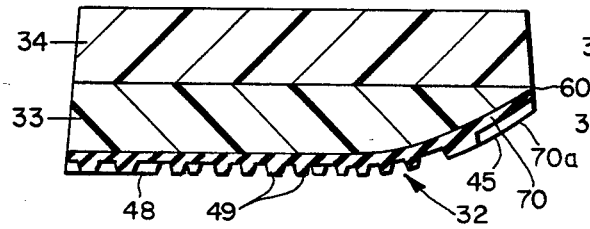
FIG. 9 is a section taken substantially along lines 9—9 of FIG. 6.
Figure 10:
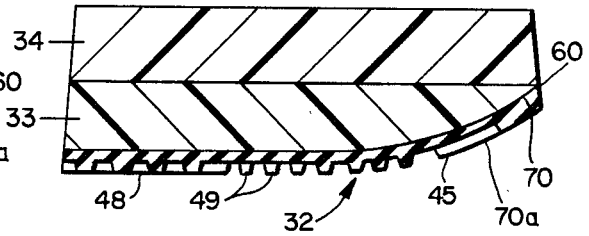
FIG. 10 is a section taken substantially along lines 10—10 of FIG. 6.
Figure 11:
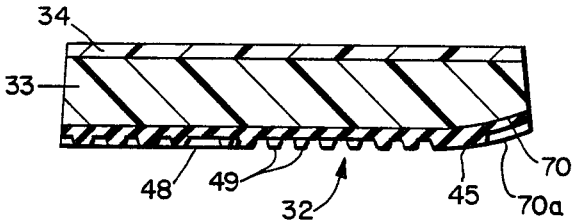
FIG. 11 is a section taken substantially along lines 11—11 of FIG. 6.

The virtual apex of envelope 72 lies behind the back of the sole's heel region and is laterally offset from centerline 42 on the lateral side of centerline 42. The diameter of envelope 72 therefore increases in a direction extending from the heel end toward the toe end of the shoe. The radius of curvature of surface 70 therefore progressively increases in a direction extending toward the toe end of the shoe as shown in FIGS. 9–11.

Still referring to FIGS. 3 and 4, axis 74 is fixed relative to the shoe and is located so that it passes through a point 76 lying in a vertical plane 78 which perpendicularly intersects centerline 42. Plane 78 lies forwardly of the rear edge of the shoe last for the shoe by dimension B (see FIG. 4). The perimeter of the shoe last is depicted by line 81 in FIG. 4. Dimension B is approximately equal to 25% of the length of the shoe last as measured along centerline 42.

When axis 74 is projected into the horizontal plane depicted by line 80, it passes through the intersection between plane 78 and centerline 42 at about a 20° angle as previously described.

The horizontal plane depicted by line 80 contains the upper flat surface of heel wedge 34 lying behind the vertical plane 78. The thickness of heel wedge 34 is uniform in the rearquarter region extending from the back of the heel to plane 78.

Point 76 is located vertically above the above-mentioned horizontal plane (which is depicted by line 80) by a dimension C. Dimension C is preferably equal to dimension B and is about 2¼ inches. The apex angle of the conical envelope 72 is about 84°.

From the foregoing description it will be appreciated that axis 74 intersects the horizontal plane depicted by line 80 at a point lying near the back heel edge of the sole between centerline 42 and the sole's lateral side edge. From this point, axis 74 rises obliquely to cross centerline 42 at point 76.

Figure 5:
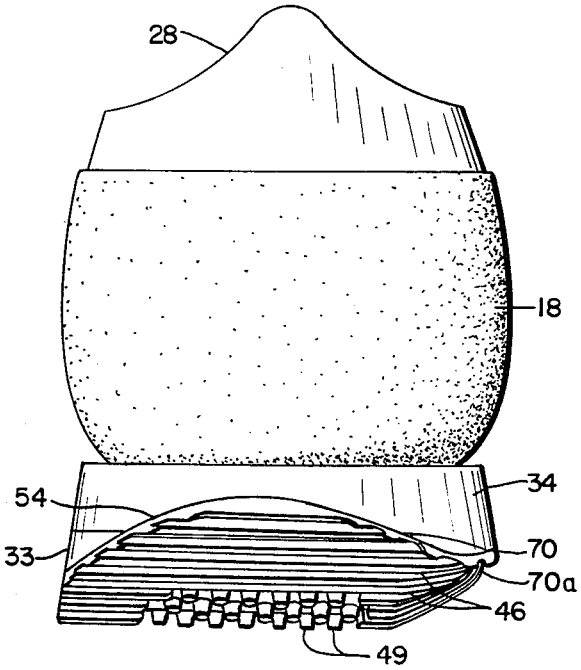
FIG. 5 is a rear elevation of the athletic running shoe shown in the previous Figures.
Figure 8:
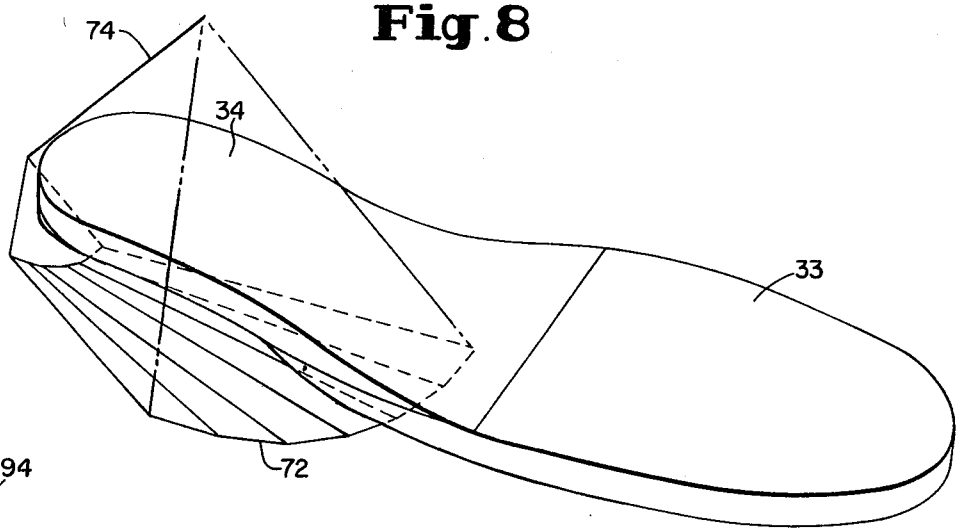
FIG. 8 is a perspective view of the midsole shown in FIG. 7.

Being thin and flexible, outsole 32 matingly conforms to the curvature of surface 70 and also to the remainder of the underside of midsole 33. Outsole 32 thus seats against and is bonded to surface 70 throughout the entire region of surface 70, as well as the remainder of midsole 33. Outsole 32 is therefore contoured in the same manner as midsole 33 to provide a corresponding arcuate surface **70*a* (see FIG. 5) having the same curvature as surface 70. Like surface 70, surface 70*a* is also contained in a conical envelope having axis 74** as its axis of symmetry.

Surfaces 70 and **70*a* are coextensive. They extend from the back edge of the lateral border at the forward edge of the curved heel portion 54 to a forefoot region lying near to but behind the fifth metatarsal head. Surfaces 70 and 70*a* extend inwardly toward centerline 42 along a smoothly curved borderline 82 (see FIG. 6) which progressively increases in width in opposed directions toward to a maximum width at a smoothly curved peak 84 in the region of the juncture between the sole's rearfoot and midfoot portions. Surfaces 70 and 70*a* lie entirely on the lateral side of the centerline 42**.

The contoured midsole surface 70 merges smoothly with a flat bottom surface 90 of midsole 33 such that the flat bottom surface is tangential to surface 70 at the surfaces' juncture which is depicted by borderline 82. Because outsole 32 assumes the same configuration as the bottom of midsole 30, the uncontoured outsole bottom region lying in a horizontal plane also lies tangential to and merges smoothly with the surface region **70*a*. The surface region 70*a* is defined by the ground-engaging end faces of ribs 45 and nubs 49 lying in the area that is bordered by borderline 82 and the lateral side edge of the sole. It will be appreciated that the outsole's major surface 52 also assumes the same configuration of surface 70**.

Because of its curvature, surface **70*a* provides a stable landing for runners who make initial contact along the outsole's lateral border. Furthermore, the shoe will roll smoothly when making ground contact along reference 70*a*. Being radiused about an average subtalar axis (i.e., axis 74), surface 70*a*** therefore enables the runner to pronate smoothly and freely, rather than abruptly, in making the transition from initial foot contact along the lateral border to a flat or midsupport position.

Figure 7:
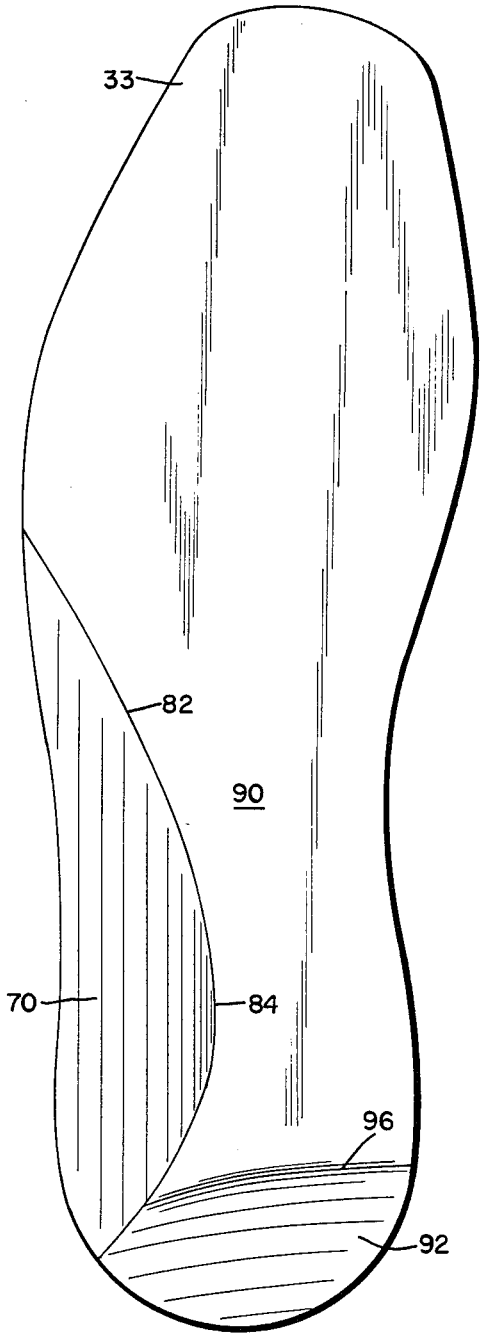
FIG. 7 is a bottom plan view of the contoured midsole shown in the previous Figures.
Figure 12:
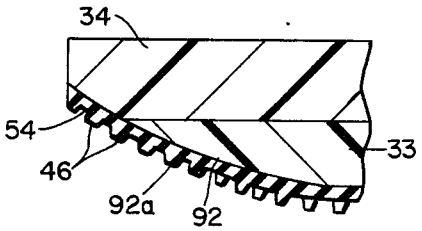
FIG. 12 is a section taken substantially along lines 12—12 of FIG. 6.

Referring to FIGS. 7 and 12, the bottom of midsole 33 is also contoured along the rear heel region to provide an arcuate surface 92 which curves radially and smoothly upwardly toward the rear heel edge of the sole. The rear portion of surface 92 may be formed on heel wedge 34 as shown in FIG. 12. Surface 92 has a uniform radius of curvature to lie in a cylindrical envelope having a longitudinal axis of symmetry 94 (see FIGS. 3 and 4). Axis 94 is at least approximately coincident with an average ankle axis for different individuals. The foot movement provided by the ankle joint is about the ankle axis which extends transversely of the foot's midline.

The average ankle axis, as represented by axis 94, extends perpendicular or at least approximately perpendicular to axis 42 and, consequently, to the midline of the foot as viewed in horizontal plan. Axis 94 therefore extends transversely of axis 74 as shown in FIG. 4.

In the vertical projection in FIG. 3, axis 94 crosses over the average subtalar axis 74 and lies above the subtalar axis 74 by a vertical dimension D. Dimension D is about ½ inches. Axis 94 crosses over axis 74 approximately at the location where axis 74 intersects the vertical plane 78.

The juncture between the contoured midsole surface 92 and the midsole's flat bottom surface 90 is defined by a borderline 96 in FIG. 7. At borderline 96, the midsole's flat bottom surface 90 lies tangential to the contoured midsole heel surface 92 so that it smoothly merges with surface 92. As shown in FIG. 7, a portion of surface 92 lying on the medial side of axis 42 is contiguous with surface 70.

The outsole's rear heel region 54, where straight heel strikers make initial foot contact, underlies midsole surface 92 and matingly conforms to the curvature of surface 92 as best shown in FIG. 12. The rear heel portion 54 of outsole 32 seats against and is bonded to surface 92. The rear heel region of outsole 32 therefore assumes the same contour as midsole surface 92 to provide an arcuate surface **92*a* having the same curvature as surface 92**.

Accordingly, surface **92*a* is contained in a cylindrical envelope having axis 94 as its longitudinal axis of symmetry. The surface region 92*a* is defined by the ground engaging end faces of ribs 46 and nubs 49 lying in the area that is bordered by borderline 96** and the sole's rear heel edge.

Because of its curvature, surface **92*a* provides a stable landing surface for straight heel strikers, and because it is radius about axis 94, surface 92*a*** enables the straight heel striker to rotate his foot smoothly and freely about his ankle axis.

As shown in FIG. 3, toe wrap 36 has a uniform radius of curvature and is advantageously radiused about axis 94, enabling runners to freely and smoothly toe off.

As mentioned in the introduction of this specification, the contoured midsole/outsole configuration may be used with or without the previously described outsole tread pattern of rib and nub formations. However, sole-to-ground contact is enhanced by combining the tread pattern with the contoured sole configuration, particularly along surface **70*a* where ribs 45 curve up following the contour of midsole surface 70** to grip the ground upon initial foot strike and during the transition to a flat or midsupport position.

Figure 16:
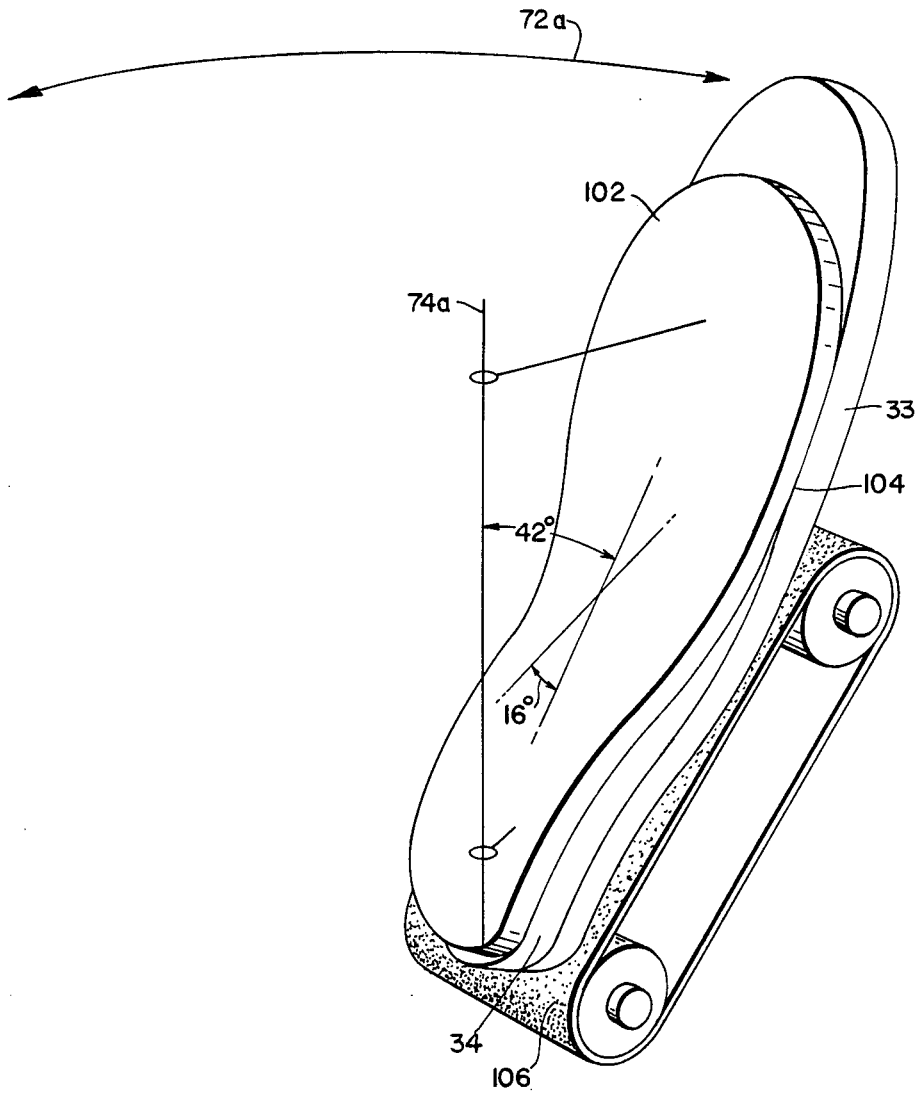
FIG. 16 is a partially schematic view of the fixture and grinding belt assembly which is used for contouring the midsole.

In order to contour midsole 33, an uncontoured midsole and heel wedge unit 33,34 may be ground to provide the midsole with the contoured surfaces 70 and 92 in any suitable fixture and grinding assembly. FIG. 16 schematically illustrates a fixture having a midsole mounting part 102 which is pivotally mounted about a fixed, simulated average subtalar axis 74*a*corresponding to axis 74.

The midsole unit 33,34 seats against and is detachably fixed to end face 104 on part 102 by any suitable means (not shown) in the path of a grinding belt 106 having a surface 107 which simulates the ground surface. The orientation of axis 74*a* relative to the midsole mounting end face 104 is the same as the orientation of axis 74 to the top surface of the contoured midsole unit 33,34 in the shoe. The end face 104 of part 102 is comparable to the bottom of the shoe last used to make upper 10. When the uncontoured midsole unit 33,34 is attached to end face 104, the orientation of axis 74*a* to the top surface of the uncontoured midsole unit 33,34 will be the same as the orientation of axis 74 to the top surface of the contoured midsole unit in the shoe.

Upon mounting the midsole unit 33,34 on part 102, part 102 is articulated about axis 74*a* along the conical envelope 72*a* so that belt 106 engages the midsole to grind down the portion bordered by borderline 82 and to thereby form midsole surface 70. The extent of grinding is referenced to the configuration where the midsole's flat bottom 90 lies tangentially to the contoured surface 70.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In an athletic running shoe, a sole structure having a ground-engaging bottom which is contoured along a portion of the lateral border of the bottom to provide an arcuate landing surface for runners who make first foot strike along a portion of the lateral border, said arcuate surface curving smoothly upwardly and away from the ground in the direction of the lateral edge of the sole structure and extending to the lateral edge of said sole structure and being radiused about a preselected oblique axis which crosses the rearquarter centerline of said shoe, said centerline bisecting the rearquarter of said sole structure.

2. The athletic running shoe defined in claim 1 wherein said arcuate surface lies at least approximately in a conical envelope and has a progressively increasing radius of curvature extending forwardly toward the toe end of said shoe.

3. The athletic running shoe defined in claim 1 wherein said arcuate surface lies at least approximately in a conical envelope and having a progressively increasing radius in a direction extending toward the toe end of said shoe, and said axis being inclined upwardly in a direction extending toward the tow end of said shoe.

4. The athletic running shoe defined in claim 3 wherein said preselected axis simulates a subtalar axis.

5. The athletic running shoe defined in claim 4 wherein said preselected axis coincides with an average subtalar axis having about a 42° inclination in a vertical plane and intersecting said centerline at about 20° in a horizontal plane.

6. The athletic running shoe defined in claim 1 wherein said arcuate surface has a progressively increasing radius of curvature extending forwardly in the direction of the toe end of said shoe and said oblique axis being inclined upwardly in the direction of the toe end of said shoe and crossing the rearquarter centerline of the shoe from the lateral side of said centerline to the medial side of said centerline in a direction extending away from the heel end of said shoe.

7. The athletic running shoe defined in claim 6 wherein said arcuate surface lies entirely on the lateral side of said centerline.

8. The athletic running shoe defined in claim 7 wherein said arcuate surface extends from a region underlying the wearer's rearfoot to a region underlying the wearer's forefoot, but terminating rearwardly of the tips of the wearer's toes.

9. The athletic running shoe defined in claim 1 wherein said sole structure comprises an outsole defining said ground-engaging bottom and a foamed, shock-absorbing midsole overlying and attached to said outsole.

10. The athletic running shoe defined in claim 9 wherein said bottom of said midsole has the contour of said arcuate surface, and wherein said outsole seats against the bottom of said midsole and is sufficiently thin and flexible to conform to the contour of said midsole.

11. The athletic running shoe defined in claim 10 wherein said outsole is integrally formed with an array of parallel, spaced apart ground-gripping ribs lying along said lateral border and extending inwardly toward said centerline from the lateral side edge of said outsole, said ribs lying along said arcuate surface and extending normal to a line which intersects said centerline at an acute angle of about 16 degrees so that they lie at least approximately perpendicular to the direction of travel for runners who toe out by an angle of 16 degrees.

12. The athletic running shoe defined in claim 11 wherein said ground-engaging bottom is contoured to provide a further curved landing surface for straight heel strikers along the rear heel portion of said sole structure, said further landing surface curving upwardly and away from the ground in a direction extending rearwardly toward the back heel edge of said sole structure, and said further surface having a uniform radius of curvature about a further preselected axis extending transversely of said centerline and said oblique axis and crossing over said oblique axis in a vertical plane.

13. The athletic running shoe defined in claim 12 wherein said sole structure comprises an outsole defining said ground-engaging bottom and a foamed, shock-absorbing midsole overlying and attached to said outsole, and wherein said outsole is integrally formed with an array or parallel, spaced apart ground-gripping ribs lying along said further landing surface and extending at least approximately perpendicular to said centerline.

* * * * *